United States Patent [19]

Kohl

[11] 3,998,074

[45] Dec. 21, 1976

[54] YARN GUIDE UNITS FOR JACQUARD CONTROLLED WARP KNITTING MACHINES

[76] Inventor: Karl Kohl, Chlorodont Str. 10, Obertshausen, Germany, 6053

[22] Filed: Mar. 15, 1976

[21] Appl. No.: 666,564

[30] Foreign Application Priority Data

Mar. 17, 1975 Germany ..... 2511550

[52] U.S. Cl. ..... 66/214

[51] Int. Cl.[2] ..... D04B 23/00; D04B 27/00

[58] Field of Search ..... 66/86 M, 86 R

[56] References Cited

UNITED STATES PATENTS 3,834,193 9/1974 Wilkens ..... 66/86 M X

*Primary Examiner*—Ronald Feldbaum

*Attorney, Agent, or Firm*—Behr & Woodbridge

[57] ABSTRACT

There is provided a yarn guide unit for use with Jacquard controlled warp knitting machines. The guides comprise a plurality of conventional yarn guides and, between each yarn guide there is provided a shorter, rigid tab. The guides and the tabs are mutually oriented so that the head of the tab contacts an adjacent face of its neighboring yarn guide. The contacted face of the yarn guide is always the side of the yarn guide other than that contacted by the influencing Jacquard dropper pin. The effect achieved by the presence of rigid contacting tabs is to both reduce feathering of the yarn guides after withdrawal of the influencing Jacquard dropper pin and to insure that the yarn guide, on the immediately following stitch cycle is correctly oriented in the warp knitting machine with respect to the needle bed.

9 Claims, 6 Drawing Figures

YARN GUIDE UNITS FOR JACQUARD CONTROLLED WARP KNITTING MACHINES

BACKGROUND OF THE INVENTION

In Jacquard controlled warp knitting machines two basic problems exist with respect to the yarn guides. Because of the modus operandi of such equipment, namely, the displacement of yarn guides by the action thereon of the Jacquard dropper pins, it is necessary that the guides themselves are made of very flexible material. Thus, when the influence of the Jacquard dropper pin is removed, the guides spring back and feather. Thus, where it is desired to operate at high machine speeds utilizing narrow needle separations, it has not been possible to precisely reorient the previously deinfluenced guides in their proper positions in time for the next stitch cycle.

Partial solutions to this problem have been suggested but have not served to solve the problem entirely. German Pat. No. 697,335 assigned to Dr. Ing. C. Knobloch, proposes the interposition of a series of tabs between the guides. This system, while it has other characteristics, not relevant to the present invention, may be characterized in two important respects. First, the tabs are located on the same side of the guides as is connected by the Jacquard dropper pin. In the operation of the Knobloch device, the guide is first influenced by the dropper pin in a gross manner and a fine adjustment is made to the displacement caused by the dropper pin, by the subsequent action of the intervening tab. Upon removal of the Jacquard pin and the reorientation of the tab to its at rest position a moderate damping of the resultant feathering of the guide does occur. However, this desirable effect is cut down firstly by the fact that the tabs are oriented on the dropper pin side as said heretofore and secondly, that in view of the fact that in the Knobloch machine the tabs can also serve as secondary yarn guides they must of necessity be somewhat flexible and in their very flexibility lies their lack of ability to reorient the principal yarn guides.

The interposition of rigid tabs between yarn guides of a warp knitting machine is disclosed in German Pat. No. 1,777,059 to Barfuss. While in this device the tabs are rigid, it should be noted that they are oriented to be substantially parallel to, and out of contact with the yarn guide in the at rest position. Furthermore, the Barfuss' device is not a Jacquard dropper pin controlled device, but rather a device wherein threads attached to the Jacquard control mechanism are attached to the yarn guides themselves to influence said guides. In the Barfuss' device, the rigid tabs serve as conduits for these threads. Clearly such a device operates on different principles and cannot possibly operate at the speed of dropper pin Jacquard controlled machines. It should further be noted that apart from the incidental effect of cutting down on some feathering, there is nothing in the Barfuss' device to positively assist in the orientation of the yarn guides in time for the commencement of the next following stitch cycle.

SUMMARY OF THE INVENTION

There is provided a yarn guide unit for use with Jacquard dropper pin controlled warp knitting machines which is so designed that the feathering of the yarn guides after removal of the dropper pin influence is substantially reduced and the reorientation of said yarn guides in time for the next stitch cycle is substantially improved.

In this improved unit, rigid tabs, shorter than the yarn guides, are placed between each yarn guide. The head portion of said shorter tabs contact one of the faces of an adjacent yarn guide. The contact point is always provided on the same side of the yarn guide, namely, the side of the yarn which is other than that to be contacted by the dropper pin when the unit is installed in the warp knitting machine. Several modifications of this invention which adhere to this basic principle are possible and are illustrated and discussed in further detail hereinbelow.

In all of the foregoing figures, which indicate the "at rest" positions of the yarn guides, the said yarn guides are, during the operation thereof in the warp knitting machine, influenced from side J1 to side J2 by the Jacquard dropper pins which contact on said J1. The dotted line q—q in FIG. 4 indicates an arbitrary line of demarcation between the head portion and the shaft portion of the tabs.

The mode of reference to the transverse axis AA and general plane AA—AA are adapted from applicants U.S. Pat. No. 3,895,503 relating to another yarn guide unit.

DESCRIPTION OF THE PREFERRED EMBODIMENTS

In the discussion of the preferred embodiments set forth hereinbelow wherein different embodiments relating to different figures are discussed, the last two digits of two or three digit numbers indicate the same part or portion of the overall device. In the three digit numbers the first digit indicates that the basic portion indicated by the final two digits is oriented in a particular manner.

In all of the embodiments of the present invention there is provided a conventional mounting unit 10. There are also provided a plurality of yarn guides 20 and tabs 30, said tabs 30 being shorter than guides 20, suitably but not critically tabs 30 are about half as long as guides 20.

Figure 6:
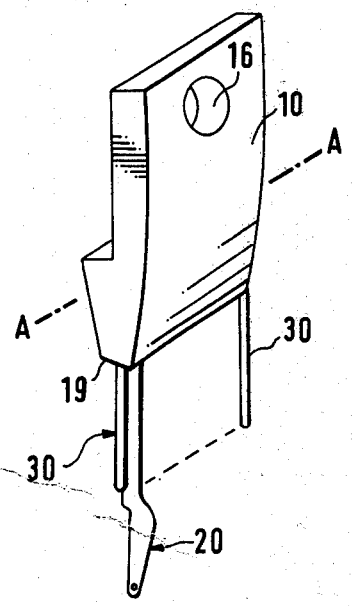
FIG. 6 is a side elevational perspective view of FIG. 2 showing the location of the transverse axis A within the principal plane AA—AA of the mounting unit.

The mounting units 10 have a general plane designated AA—AA. Further, FIG. 6 shows the transverse axis A of said mounting unit. The transverse axis is an arbitrary line proximate to the mounting hole 16 passing through the mounting unit 10 parallel to edges 17 and 19 which provide between them the face in which the guides 20 and tabs 30 are mounted, suitably soldered, in the conventional manner.

Figure 1:
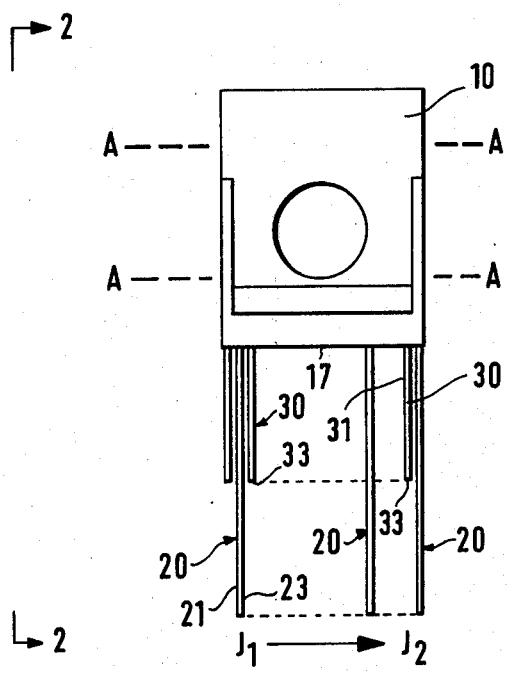
FIG. 1 is a plan view of a yarn guide unit showing the alternation of tabs and yarn guides. It does not illustrate any of the modes in which the tabs and the guides contact each other. It does further show the location of the general plane AA—AA of the mounting unit.
Figure 2:
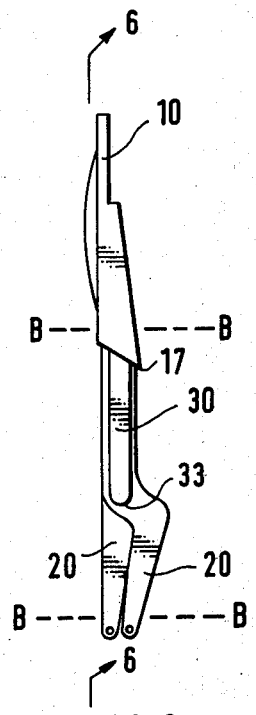
FIG. 2 is a side elevational view of FIG. 1 viewed from 2—2 further including an indication of the plane BB—BB to which the side elevational view of planes of the faces of the yarn guides of the preferred embodiments of the present invention lie parallel.

In FIG. 2 the plane joining edges 19 and 17 is shown at an angle to the longitudinal axis of the shaft portion of tab 30. It is to be considered within the scope of the present invention that said plane 19 – 17 could also be perpendicular to or at any other angle to said longitudinal axis of the shaft of tab 30. The tabs 30 and the yarn guide 20 are oriented with respect to the aforesaid transverse axis A in such a manner that the head portion 33 of tab 30 contacts side 23 of yarn guide 20 in the "at rest" position. In the operation of a Jacquard controlled warp knitting machine equipped with yarn guide units in accordance with the present invention, the Jacquard controlled dropper pin (not shown) will contact side 21 of yarn guide 20, causing said yarn guide 20 to move in the direction J2 as shown in the drawings.

FIG. 2 further shows an axial plane BB—BB. This is a theoretical plane. In the embodiments shown the side elevational views of faces 21 and 23 of the yarn guides 20 lie parallel to this plane, the longitudinal axes of the shaft portion of guides 20 and tabs 30 lie parallel to this plane and said plane is perpendicular to general plane AA—AA of the mounting unit 10.

As said heretofore, the essential element of the present invention is that head portion 33 of tab 30 shall be in contact with side 23 of yarn guide 20. The orientations of the shafts of the said guides 20 and said tabs 30 with respect to the transverse axis of the mounting unit are important only so far as they serve to more clearly define the preferred embodiments of the present invention as illustrated herein and discussed hereinbelow.

Figure 3:
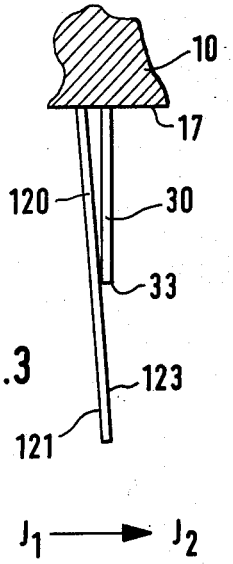
FIG. 3 is a close-up side elevational view of a first preferred embodiment of the present invention. The tab is oriented perpendicular to the transverse axis of the mounting unit and the yarn guide is oriented at an angle other than 90° to said transverse axis.

In FIG. 3, illustrating the first preferred embodiment of the present invention, tab 30 is a single rigid unit having a longitudinal axis therethrough. Said longitudinal axis being perpendicular to the transverse axis AA of the mounting unit. The shaft portion of yarn guide 120 is provided with two faces 121 and 123 which both subtend an angle which is other than perpendicular to edge 17 and of course transverse axis AA. In this modification end 33 of tab 30 contacts guide 120 on side 123.

Figure 4:
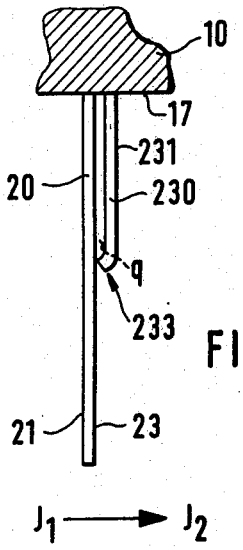
FIG. 4 is a close-up side elevational view of a second preferred embodiment of the present invention wherein both the yarn guide and the shaft portion of the tab subtend an angle of 90° to the transverse axis. However, the head portion of the tab is oriented towards and in contact with the adjacent yarn guide.

The second embodiment illustrated in FIG. 4 comprises an embodiment wherein both guide 20 and shaft portion 231 of tab 230 subtend an angle of 90° to transverse axis AA, tab 230 is provided with a head portion 233, arbitrarily differentiated from shaft portion 230 by line *q—q*, which is bent towards and contacts with side 23 of guide 20.

Figure 5:
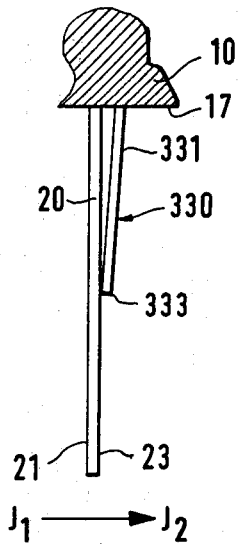
FIG. 5 is a close-up side elevational view of the third preferred embodiment of the present invention wherein the yarn guide subtends an angle of 90° to the transverse axis and the tab subtends an angle other than 90° to said transverse action.

A third embodiment is illustrated in FIG. 5 wherein guide 20 has a longitudinal axis perpendicular to transverse axis AA and the longitudinal axis of tab 330 is at an angle other than 90° to transverse axis AA and end 333 of tab 330 contacts side 23 of guide 20.

It will be readily apparent to those skilled in the art that modifications of the foregoing preferred embodiments of the present invention utilizing the principles set forth herein may be employed. Nevertheless, such modifications are to be considered to be within the scope of the present invention.

I claim:

1. A yarn guide unit for use in Jacquard controlled warp knitting machines comprising:

a. a mounting unit, said mounting unit having a transverse axis, b. a plurality of yarn guides each guide being substantially flat and comprising a shaft portion and a head portion connected thereto, and having a first and second face, all of said first faces facing in one direction, and all of said second faces facing in the opposite direction, said shaft portion having a longitudinal axis, c. a plurality of rigid tabs, said tabs being shorter than said guides and comprising a head portion and a shaft portion connected thereto, said shaft portion having a longitudinal axis, said shaft portion of said yarn guides and said shaft portion of said tabs being mounted side-by-side in said mounting unit, said tabs alternating in said mounting unit with said guides, wherein the free end of the head portion of the tabs contacts said first face of the yarn guide adjacent thereto.

2. A yarn guide unit in accordance with claim 1, the longitudinal axes of said shaft portions of said guides lying on a first common plane the planes of said first face and said second face of said guides being perpendicular to said first common plane the longitudinal axes of the shaft portions of said tabs lying on a second common plane said longitudinal axes of said shaft portion of said guides and said longitudinal axes of said shaft portions of said tabs subtending sufficient angles to said transverse axis of said mounting unit to provide contact between said head portions of said tabs and said first side of said adjacent yarn guide.

3. A yarn guide unit in accordance with claim 2, wherein said angles subtended by the longitudinal axes of said shafts of said guides to said transverse axis is 90°.

4. A yarn guide unit according to claim 3 wherein the angle subtended by the longitudinal axes of said shafts of said tabs is other than 90°.

5. A yarn guide unit in accordance with claim 4 wherein said head portion and said shaft portion of said tabs have a common longitudinal axis.

6. A yarn guide unit in accordance with claim 3 wherein the angles subtended by the longitudinal axes of said tabs to said transverse axis is 90° and said head portion of said tabs is sufficiently oriented towards said adjacent yarn guide to contact the first face thereof.

7. A yarn guide unit in accordance with claim 2 wherein the angle subtended by said longitudinal axis of said shaft of said guides to said transverse axis is other than 90°.

8. A yarn guide unit in accordance with claim 7 wherein the angle subtended at said transverse axis by the shafts of said tabs is 90°.

9. A yarn guide unit in accordance with claim 8 wherein said head portion and said shaft portion of said tabs have a common longitudinal axis.

* * * * *